United States Patent [19]

Jabben

[11] Patent Number: 4,539,445

[45] Date of Patent: Sep. 3, 1985

[54] CLICK DISC SWITCH ASSEMBLY

[75] Inventor: Gary D. Jabben, Shreveport, La.

[73] Assignee: AT&T Technologies, Inc., Berkeley Heights, N.J.

[21] Appl. No.: 564,961

[22] Filed: Dec. 23, 1983

Related U.S. Application Data

[63] Continuation-in-part of Ser. No. 451,358, Dec. 20, 1982, Pat. No. 4,461,934.

[51] Int. Cl.[3] ..... H01H 13/70

[52] U.S. Cl. ..... 200/5 A; 361/401; 361/406; 361/416

[58] Field of Search ..... 361/401, 405, 406, 413; 200/5 A; 29/622, 756

[56] References Cited

U.S. PATENT DOCUMENTS

| | | | |
|---|---|---|---|
| 4,046,981 | 9/1977 | Johnson et al. | 200/5 A |
| 4,083,100 | 4/1978 | Flint et al. | 29/622 |
| 4,128,744 | 12/1978 | Seeger | 200/5 A |
| 4,461,934 | 7/1984 | Jabben | 200/5 A |

*Primary Examiner*—R. R. Kucia
*Assistant Examiner*—Arthur Grimley
*Attorney, Agent, or Firm*—R. F. Kip, Jr.

[57] ABSTRACT

There is disclosed a click disc switch assembly comprising a plate-like base having on it electroconductive ink paths including (a) "row" paths each including a respective row of contact pads in a row-and-column matrix of such pads on the base, and (b) "column" paths corresponding to the columns of the matrix and including respective junction pads. Overlying the columns of the matrix are click disc strips secured to the rest of the assembly solely by being adhered to an overlying sheet sealing the top of the assembly. Interposed between the strips and the "row" paths is an insulating layer deposited on the base to cover portions of the row paths while leaving uncovered their junction pads. Each click disc is electrically coupled to the corresponding "column" path on the base by the coming into contact of the disc when depressed to branch segments of a further electroconductive ink path (one for each click disc strip) deposited on the insulate layer and attached through an aperture therein to the junction pad of that "column" path. Variations in the thickness of the paths on the base and on the layer are cancelled out by depositing on the base, below the click discs, pairs of bars of the same thickness as the lead portions of the paths on the base, and by raising the contact pads by an amount equal to the thickness of the paths on the layer. The base is a laminar member comprising an overlying flexible plastic sheet adhered to an underlying stiffening board. The assembly may include a tail for connecting it to other circuitry.

7 Claims, 5 Drawing Figures

CLICK DISC SWITCH ASSEMBLY

RELATED APPLICATION

This application is a continuation-in-part of Ser. No. 451,358, filed Dec. 20, 1982 now U.S. Pat. No. 4,461,934 issued July 24, 1984 in the name of Gary D. Jabben for "Click Disc Switch Assembly".

FIELD OF THE INVENTION

This invention relates generally to click disc switch assemblies providing an X-Y matrix of make-break switch contacts adapted to each be actuated by a respective one of the keys of a keyboard. More particularly, this invention relates to improved modes in such assemblies of securing the overlying members which carry the click discs to the crest of the assembly, and to other improvements.

BACKGROUND OF THE INVENTION

Devices employing click discs as contact elements in an X-Y matrix of switch contacts have been known for a number of years. For example, such a device for use with an electronic calculator keyboard is described in U.S. Pat. No. 4,005,293 issued Jan. 25, 1977 in the name of Henry J. Boulanger and incorporated herein by reference.

My U.S. Pat. No. 4,392,181 issued July 5, 1983 and incorporated herein by reference discloses a click disc assembly comprising a planar molded plastic substrate and twelve contact dots of electroconductive ink arranged on such substrate in a 3×4 X-Y matrix consisting of four "X" rows of three contact dots each forming these "Y" columns. The dots in each of the four "X" rows are included in four corresponding paths of electroconductive ink deposited on the substrate and leading to four corresponding "row" terminal locations within a terminal region or zone at one end of the substrate. The dots in each row are thereby all electrically connected to a respective one of such locations.

Overlying the three "Y" columns of the matrix are three steel strips each having formed within its edges four click disks electrically connected to the edge portions of that strip and each disposed above a respective one of the four contact dots in that column. An insulating layer separates the strips from the paths on the substrate except in areas beneath the click discs where the layer has holes therein to permit the discs to contact their underlying contact dots. Each click disc by touching such dot electrically couples the "column" strip of which the disc is a part to the "row" electroconductive path of which the dot is a part. The edge portions of the three column strips extend to the mentioned terminal zone on the substrate to have end tabs overlying three corresponding "column" terminal locations in that zone.

Within that zone, and prior to formation of the electroconductive paths on the substrate, L-shaped metal terminal pieces are inserted into apertures in the substrate at the "row" and "column" terminal locations so that one of the "L" arms of each terminal passes with a press fit through and then beyond such aperture to end in a tip outwardly salient from the substrate. The other terminal arm or head of the terminal lies flat on the substrate's upper surface. After such inserting, the "row" terminals are bonded and electrically coupled to the "row" electroconductive paths by deposition of the electroconductive ink of these paths to cover the flat heads of such terminals. The "column" terminals are, on the other hand, bonded and electrically coupled to the "column" strips by welding the mentioned end tabs of such strip's through holes in the mentioned insulating layer to the flat heads of the "column" terminals. After the "row" and column terminals have been connected up as described in the click disc assembly, the outwardly projecting tips of the terminals are soldered to plated rectangular slots formed in a printed circuit card disposed below and spaced from the substrate board of the click disc assembly. In this manner, the X-Y switch contact matrix of such assembly is connected through the soldered terminals to operating circuitry on the printed circuit card to provide, say, a complete telephone dial unit.

My copending application Ser. No. 451,358 filed Dec. 20, 1982 and incorporated herein by reference discloses a click disc switch assembly differing from that disclosed in my U.S. Pat. No. 4,392,181 in at least the respects that the electroconductive conductors on the substrate are of copper so as to provide copper contact areas and pads (and, also, copper terminals on the edge of the substrate board), the click disc strips are secured by the welding of end tabs thereof to bonding pads forming parts of the copper paths on the substrate board, and the board has thereon a plurality of pairs of copper bars which are substantially of the same thickness as such copper paths, and which are disposed beneath the click discs to compensate for the effect on the "click feel" of the click discs of variations from nominal in the thickness of the contact areas on the board which are contacted by the click discs upon depression thereof.

While the last mentioned click disc assembly has been found to be quite satisfactory, it has the disadvantages of high cost to produce its copper paths on its substrate board. Too, the board must, in order to have such paths formed thereon, be made of a material which is relatively expensive and productive of more contamination than is desirable. Moreover, in the case of both the click disc assembly of my U.S. Pat. No. 4,392,181 and that of my application Ser. No. 451,358, the necessity for having the click disc strips secured to underlying parts of the assembly adds to the cost, effort and time involved in making the assembly.

SUMMARY OF THE INVENTION

One or more of these and other disadvantages are overcome by a click disc assembly in which, in accordance with an aspect of the invention, the assembly is improved by maintaining the click disc strips in fixed positioning in the X and Y directions of the switch matrix solely by bonding such strips to the underside of an overlying sealing sheet (such strips not being otherwise mechanically secured to the rest of the assembly), and, by providing for the strips a corresponding plurality of electroconductive "column paths" which are formed on the insulating layer underlying the strips so as to each be at least partly beneath the corresponding strip, and of which each such path is adapted at least upon depression of a click disc in such strip to electrically couple that disc to a "column" path on the base member. According to other aspects of the invention, the click disc assembly is further improved by (a) forming such paths on the insulating layer of electroconductive ink, (b) forming the paths on the base member of electroconductive ink, (c) providing a base member which is laminar in that it comprises an overlying plastic sheet, and underlying stiffening board and an intermediate adhesive layer bonding such sheet and board together, and/or (d) providing means for compensating the "click feel" of the click disc for the effect of variation from nominal in either one or both of (i) the thickness of such paths on the base member and (ii) the thickness of such paths on the insulating layer.

BRIEF DESCRIPTION OF THE DRAWINGS

For a better understanding of the invention, reference is made to the following description of exemplary embodiments thereof, and to the accompanying drawings wherein.

DESCRIPTION OF EMBODIMENT

Figure 1:
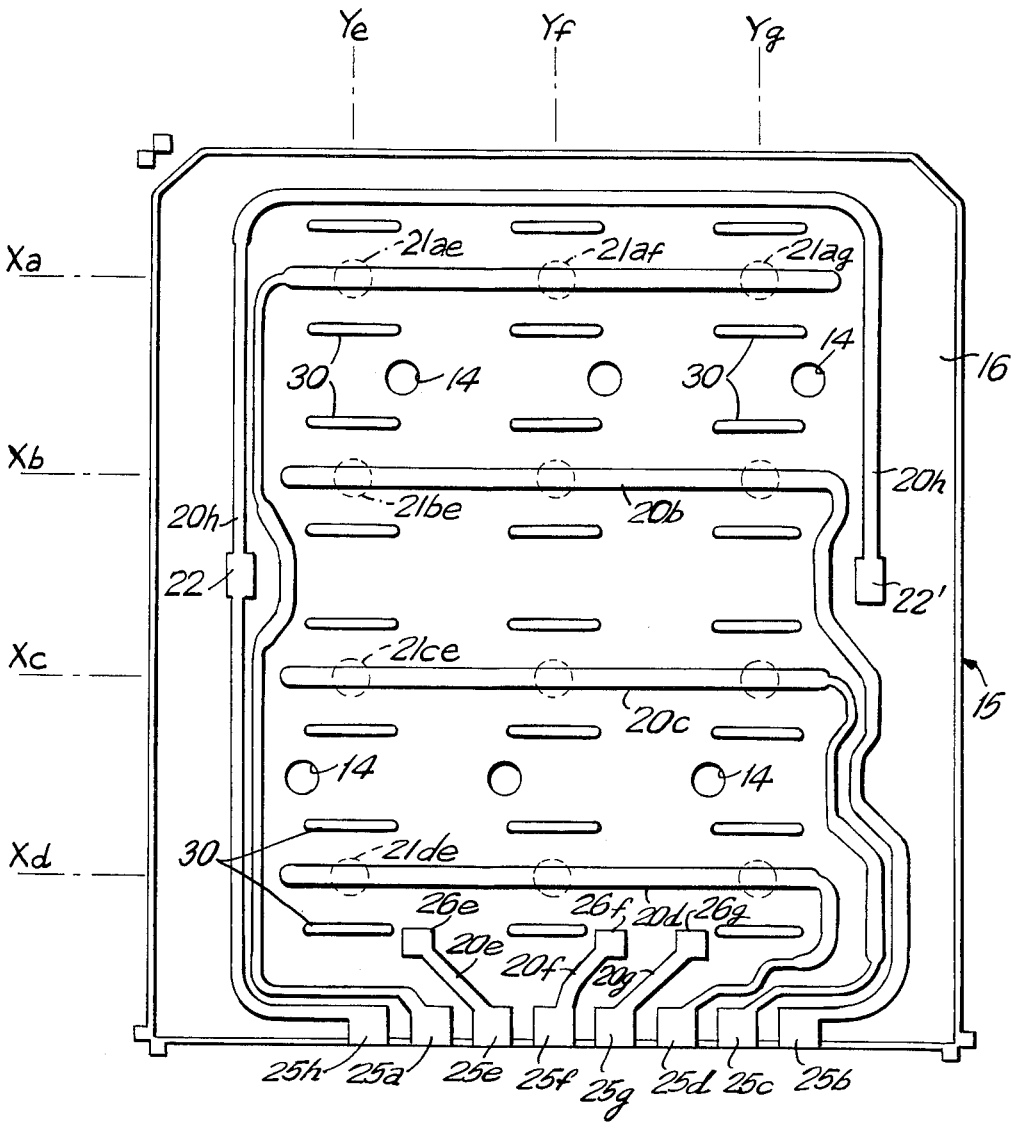
FIG. 1 is a plan view of a printed wiring board which comprises a base member with electroconductive paths thereon, and which board is part of a click disc assembly embodying improvements according to the invention.

Referring now to FIGS. 1–4, the reference numeral 10 designates (FIG. 2) a click disc assembly of which a component is (FIG. 1) a printed wiring board 15 comprising a substantially rectangular plate-like base member 16 and a plurality of electroconductive paths 20 on the front surface of the base member. Base member 16 is a laminated structure (FIG. 4) comprising (a) an overlying flexible polyester sheet 17 having a thickness of 0.005 inch, (b) an adhesive layer 18 on the underside of sheet 17 and having a thickness of 0.002 inch, and (c) an underlying rigid stiffening board 19 bonded to sheet 17 by adhesive layer 18. Stiffening board 19 is constructed of an inexpensive material such as ABS, and it has a thickness which typically is 0.022 inch, but which may be varied to suit convenience. Sheet 17 and layer 18 are perforated by aligning holes 14 which are used as later explained, but these holes do not continue through board 19. Accordingly, no dust or the like can pass upward through laminar member 16 to contaminate the interior of the click disc assembly.

The paths 20 are made of electroconductive ink and are each constituted of one or more electroconductive pads which are electrically continuous with narrower lead portions of such paths. The various paths 20 are divided into four row conductors 20*a*–20*d*, three column conductors 20*e*–20*g* and a shield conductor 20*h*.

Figure 2:
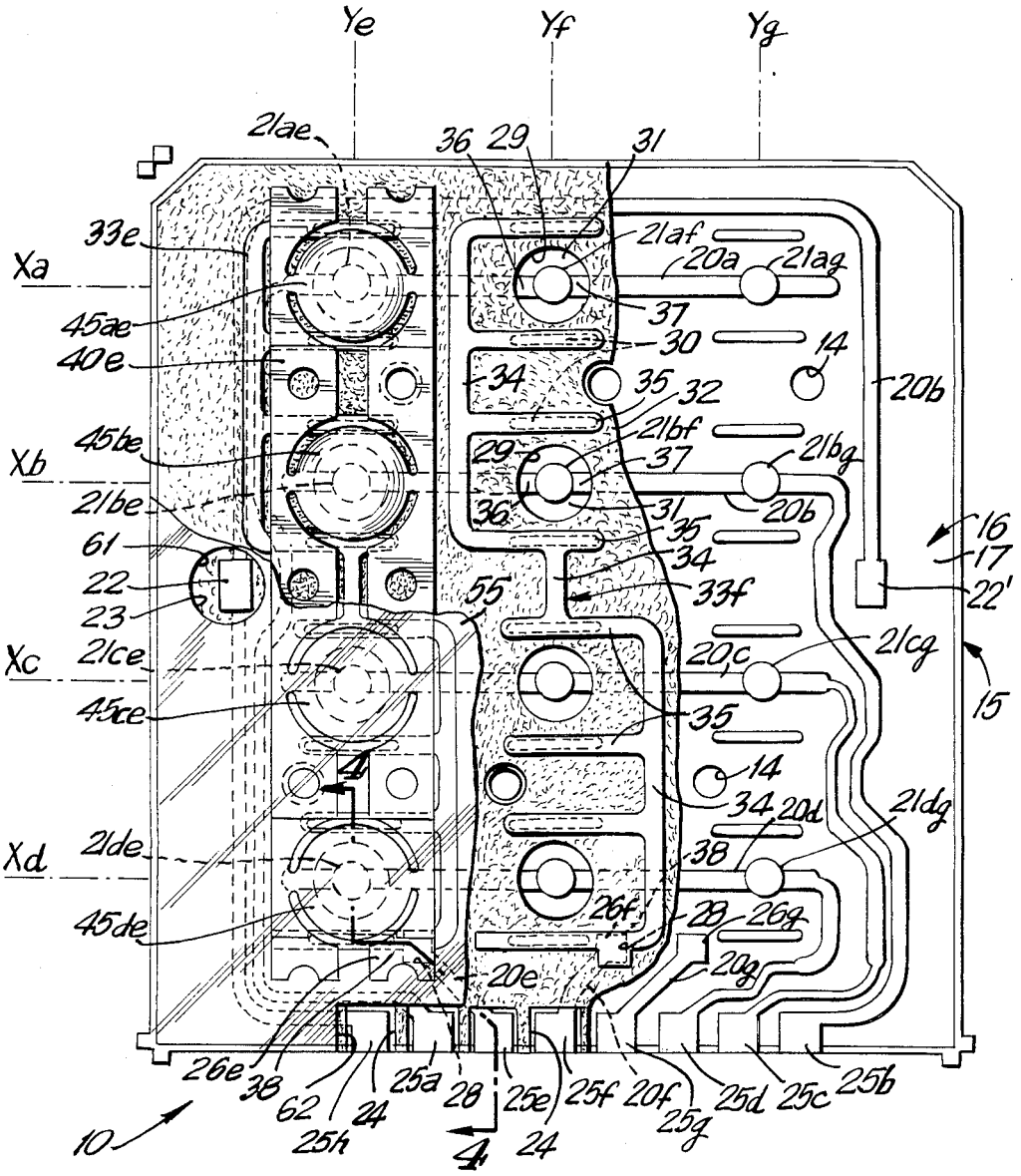
FIG. 2 is a plan view of such assembly as completed with certain overlying parts thereof being partly broken away to expose to better view certain underlying parts of such assembly.

The four row conductors each include a respective row of three contact pads 21 shown in FIG. 2 and the locations of which are shown in dotted line in FIG. 1. Pads 21 are arranged in a 3×4 array of twelve of such pads arranged in rows Xa–Xd and columns Ye–Yg to form a switching matrix. For example, row conductor 20*a* includes contact pads 21*ae*, 21*af*, 21*ag* which constitute the topmost row of pads in such matrix.

The three column conductors 20*e*–20*g* correspond to the three columns of the matrix, conductor 20*e*, for example, corresponding to the column of contact pads 21*ae*, 21*be*, 21*ce* and 21*de* which are in column Ye of the matrix. The manner in which each column conductor path 20 may be selectively coupled to any contact pad in the corresponding column will be later described.

The shield conductor 20*h* is not involved in the switching action of the matrix, such conductor being used to provide electrostatic shielding for the click disc assembly. Path 20*h* includes pad areas 22, 22'.

As shown, the eight electroconductive paths 20 include eight respective terminal pads 25 spaced from each other in a linear array thereof at the front edge of the base member 16. The three column paths 20*e*, 20*f*, 20*g* also include three respective junction pads 26*e*, 26*f*, 26*g* spaced back from their corresponding terminal pads 25*e*, 25*f* and 25*g* and rendered electrically continuous therewith by lead portions 27 of such paths.

In addition to the electroconductive paths 20, the base member 16 has thereon a plurality of pairs of bars 30 of electroconductive ink. The bars in each such pair lie on opposite sides of a respective one of the contact pads 21 in the column in which that pad is located such that those bars are normal to and bisected by the centerline for that column. The purpose of bars 30 will be later explained.

The electroconductive ink paths 20 and the electroconductive ink bars 30 are formed simultaneously on base member 16 by a conventional silk screening operation. Since the paths and bars are formed at the same time by the same process, the thickness of the bars 30 is substantially the same as that of the lead portions of paths 20.

With the paths 20 and bars 30 having been so formed, a resist material (which may, for example, be either the proprietary composition "M & T 310" sold by the M & T Chemical Company, Rahway, N.J. or the proprietary composition "Unimask 2000" sold by the Industrial Polymer Division of W. R. Grace & Co., 55 Hayden Avenue, Lexington, Md.) is applied by silk screening to the front surface of the printed wiring board 15 to coat by a thin layer of such material all of such surface of the board except for the pad areas of the paths 20, holes 14 and circular areas 31 (FIG. 2) concentrically surrounding the contact pads 21. When such thin layer has so been laid down, it is cured and solidified by ultraviolet light to form a thin solid insulating layer 32 covering bars 30 and paths 20 except for the pad areas thereof and such holes and circular areas. To put it another way, layer 32 has formed therein a plurality of apertures 23, 24, 28 and 29 located so as to provide exposures through the layer of, respectively, the holes 14, terminal pads 25, junction pads 26 and areas 31.

Layer 32 has thereon (FIG. 2) three similar electroconductive ink paths 33*e*, 33*f*, and 33*g* which correspond to the columns Ye, Yf and Yg of the switch matrix, and of which path 33*g* is not shown in FIG. 2 because of the breakaway in that figure of the portion of layer 32 on which path 33*g* is located. As exemplified by path 33*f*, each of such three paths comprises (a) a main segment 34 extending in the "X" direction and displaced in the "Y" direction away from the centerline of the "Y" column corresponding to that path, and (b) four pairs of branch segments of which each corresponds to a respective one of the contact pads 21 in the corresponding "Y" colummn, and of which the branch segments 35 in each such pair extend in the "Y" direction, away from the path's main segment 34, towards and past the centerline of that "Y" column so as to flank on either side the corresponding contact pad. As shown (FIG. 2), the branch segments 35 in each pair thereof are located to lie directly above and register with the bars 30 associated with the corresponding contact pad 21, the registering segments 35 and bars being separated from each other by an intervening thickness of layer 32. To assure registration between corresponding branch segments 35 and bars 30, those bars may, if desired, be made substantially wider than is shown in FIG. 2 by expansion in the "Y" direction to either side of each of such bars of the area occupied thereby.

Paths 33 are formed on layer 32 by a conventional silk screening operation during which dots of electroconductive ink are deposited on row paths 20 to form the contact pads 21. The ink deposited to form pads 21 merges during such operation with the ink previously deposited to form row paths 20 such that pads 21 are integral with the rest of such paths. Because, however, the ink deposited to form pads 21 is superposed on the ink originally deposited to form paths 20, the portions of such paths provided by pads 21 are raised above the path lead portions 36, 37 which are adjacent to such pads. Since the pads 21 are formed during the same silk screening operation as forms the paths 33 on layer 32, the amount by which pads 21 are raised above lead portions 36,37 is substantially equal to the thickness on layer 32 of the electroconductive ink paths 33.

The conductors 33*e*, 33*f*, 33*g* are laid out on layer 32 to pass at least in part over the apertures 28 which provide exposures through layer 32 of the junction pads 26 of the column conductors 20. Accordingly, in the course of the formation of the conductors 33 on layer 32 by silk screening, the silk screening operation produces electroconductive ink depositions which constitute junction portions 38 of paths 33, and which extend down through apertures 28 to lie on top of junction pads 26. The ink of portions 38 merges with the ink of pads 26 to become integral therewith. Junction portions 38 accordingly serve to provide an ohmic electrical coupling of each of the paths 33 on layer 32 to the respectively corresponding one of the column conductors 20 on base member 16.

The electroconductive ink paths 20 have in their lead portions a thickness which is nominally 0.00085 inch, but which can vary within tolerance limits in the range of from 0.0007 inch to 0.0010 inch. The electroconductive ink paths 33 on layer 32 have the same nominal thickness as paths 20, and the same range of possible variation within tolerance limts as paths 20 have. It follows that the contact pads 21 will have double the nominal thickness of the pad portions of paths 20, and that pads 21 will be raised above those lead portions by an amount which is nominally 0.00085 inch but can vary within tolerance limits in the range of 0.0007 inch to 0.0010 inch. Both paths 20 and paths 33 can conveniently be made from a proprietary electroconductive ink identified as "Advanced Silver Conductive Coating", Code 1-1S-20, and sold by the Advanced Coatings and Chemical Company, Temple City, Calif.

Disposed on top of insulating coating 32 are three "column" or click disc strips 40*e*, 40*f*, 40*g* aligned in centered relation with, respectively, columns Ye, Yf, Yg of the switch matrix. Since strip 40*e* is identical with the other two strips, only that strip will be described in detail.

Figure 3:
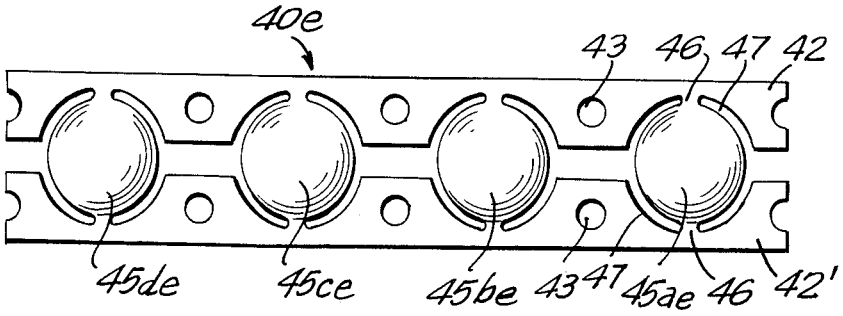
FIG. 3 is a plan view of one of the click disc strips of such assembly.
Figure 4:
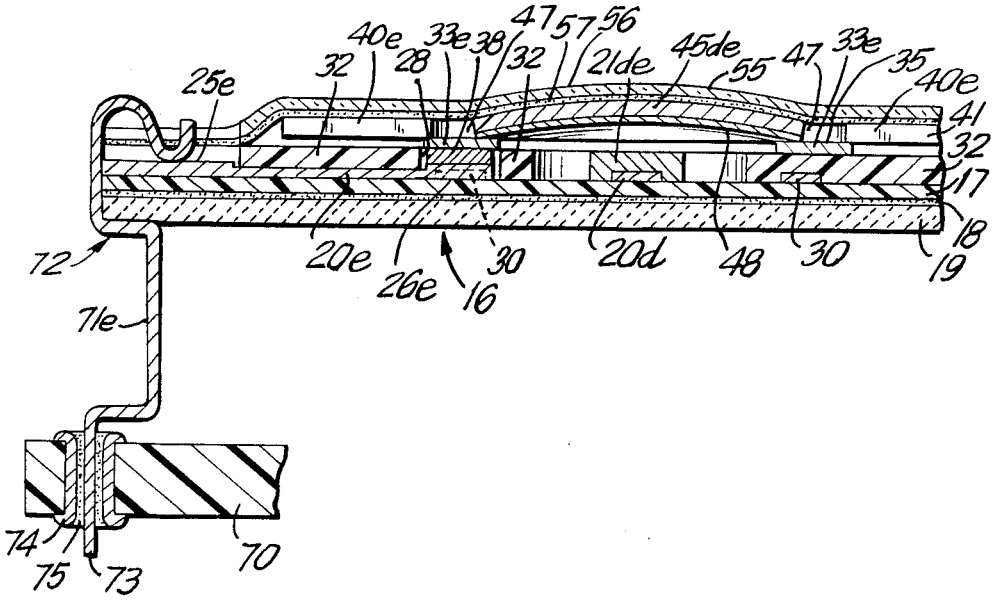
FIG. 4 is a cross-section in side elevation through such assembly as shown in FIG. 2, such crosssection being taken as indicated by the arrows 4—4 in FIG. 2 and being exaggerated and not to scale in its vertical dimensioning.

As shown in FIG. 3, strip 40*e* is an elongated strip of corrosion resistant steel 41 which may be, say, modified 302 stainless steel. The strip has a nominal thickness of 0.0038 inch. The skeleton of strip 40*e* includes two separated side portions 42, 42' on opposite sides of the strip. A plurality of aligning holes 43 are formed in portions 42, 42' to have the same pattern of relative locations as the aligning holes 14 in layers 17 and 18 of the base member 16. Also included in strip 40*f* are four click disks 45*ae*, 45*be*, 45*ce* and 45*de* joined to side portions 42, 42' by necks 46 of the steel material 41 of the strip, but otherwise separated from such side portions by arcuate slits 47. Such click discs are outwardly convex dome-shaped structures distributed along the length of strip 40*e* to have the same spacing between centers as that between the contact pads 21*ae*, 21*be*, 21*ce*, 21*de* on the base member 16. The inner surfaces (FIG. 4) of the mentioned click discs have thereon a layer 48 of gold plating.

As stated, click disc strips 40*f* and 40*g* are similar in structure to strip 40*e*. The three strips are placed in their respective columns Ye, Yf, Yg (See FIG. 5) on the insulating coating 32 such that the four click discs 45 in each strip are respectively centered over the four contact pads 21 in the corresponding column, and such that the aligning holes 43 in the strips register with the aligning holes 14. When the strips are so positioned, they are separated by coating 32 from the underlying electroconductive paths 20 except within the areas coextensive with the apertures 31 in the coating.

The structure of the click disc assembly 10 is completed by covering it with a seal 55 in the form of a polyester sheet 56 having on its underside an adhesive layer 57 by which the seal is bonded to the click disc strips 40 and (outside the areas of such strips) to the coating 32. Seal 55 is transparent. The seal has formed therein apertures 61, 61' registering with the pads 22, 22' in the shield conductor path 20*h* and a rectangular slot 62 disposed at the front edge of board 15 so as to leave exposed to access the terminal pads 25 of the board.

The bonding of sheet 55 through layer 57 both to the insulating layer 32 and to the click disc strips 40 serves to maintain these strips in fixed positioning in the "X" and "Y" directions in relation to the rest of the assembly 10. Apart from such strips being so secured through sheet 55 to the other parts of the assembly, strips 40 are not mechanically fastened in any way to the parts which lie beneath them, and the cost of providing such mechanical fastening is thereby avoided. The strips 40*e*, 40*f*, 40*g* are, however, juxtaposed with portions of, respectively, the electroconductive ink paths 33*e*, 33*f*, 33*g* beneath them so as to have contact with those path portions, which contacts may vary from intermittent to loose (and continuous) to firm (and continuous) depending on whether or not sheet 55 is loosely or tightly stretched between its areas of bonding to layer 32. Irrespective, however, of the degree of firmness of contact between strips 40 and paths 33, and when one of the click discs of strips 40 is depressed, such depression will assure the presence between such disc and the underlying branch segments 35 of a mechanically firm pressure contact which electrically couples the gold layer 48 on the underside of such disc through the associated column path 33 on layer 32 and the associated column path 20 on base member 16 to the terminal 25 for the latter path. Thus, even though the click disc strips 40 are not mechanically fastened to any portions of any underlying elements, depression of any of the click discs in such strips will produce a reliable electrical coupling between such disc and the underlying branch segments 35 and, from such branch segments, through the associated main segment 34 and junction portion 38 to the appropriate column conductor or path 20 on base member 16. With the click discs being so electrically coupled through the branch segments 35, the side portions 42 of the click disc strips 40 are not required to conduct electric current. The elimination of the need of that current carrying function of such side portions may, of course, be advantageous because it avoids the hecessity of passing current through the high resistance steel of such side portions. Further, because depression of a click disc produces contact between, on the one hand, the contact pad 21 beneath the disc and the gold layer 48 on its underside and, on the other hand, between such gold layer and the branch segments 35 underneath the gold layer 48 itself provides a current conducting bridge between that pad and those branch segments. It follows that little or no current need pass even through the steel of the discs, and that no special precautions need be taken to have a good ohmic contact between the gold layer 48 on the underside of the click discs and the steel of those discs.

The described assembly is used in the following manner. A housing (not shown) with a keyboard on top is placed over the assembly. Spring conductors (not shown) in the housing pass through the assembly's apertures 61, 61' to contact the pads 22, 22' of the shield conductor **20*h* so as to electrically ground the housing to that conductor. The terminal pads 25 of the assembly 10 are electrically connected to an underlying circuit board 70 (FIG. 4) via respective edge connectors 71. Each such connector has an upper portion in the form a "U" clip 72 which resiliently grips the front edge of assembly 10 to make ohmic contact with a corresponding terminal pad 25. The lower end of each such connector is in the form of a spade tip 73 which is inserted into a plated hole 74 in board 70 and then electrically coupled by solder 75 to the plating in such hole. In this way, the assembly 10 is electrically connected to the circuit components (not shown) on board 70**.

The mentioned keyboard includes an X-Y matrix of depressible keys each centered over a respective one of the click discs 45. As a step in the operation of device 10, one of such keys is manually depressed to resiliently deflect downward the click disc 45 below it. The disc responsively touches the contact pad 21 below it so as to make an electrical connection between the row path 20 in which such pad is included and the column path 33 and column path 20 which are electrically coupled to the deflected disc. The making and subsequent breaking of such connection is communicated via the terminal pads for such paths and the edge connectors 71 for such pads to the circuit board 70 to indicate and then terminate performance of a function. For example, if assembly 10 is associated with the keyboard of a multifrequency dialing telephone set, the making and breaking of such connection will initiate and terminate the production of a multifrequency dial tone.

There will now be considered in more detail certain features of the described exemplary embodiment.

The insulating coating 32 deposited on the printed wiring board 15 has a thickness which allowably may vary between about 0.001 inch and about 0.002 inch at places where it covers the electroconductive ink paths 20 on the base member 16. As already described, such coating serves to insulate the strips 40 from such underlying electroconductive paths 20. An additional function performed by coating 32 is that it elevates the bottom of the click disc strips 40 by an amount substantially equal to the thickness of the coating bove the top of the contact pads 21 so that, in the course of the click discs being deflected to touch those pads, the discs must pass downward beyond the bottom surface of the side portions 42, 42' of the strips 40 to undergo a negative deflection which would be from about 0.001 inch to about 0.002 inch if the thickness of the electroconductive ink paths on layers 32 could be disregarded. Such amount of negative deflection is desirable in that it provides optimal tactile feel consistent with maintaining contact bounce within acceptable values.

In connection with the foregoing, while the electroconductive lead portions 36, 37 adjacent to the contact pads 21 have a nominal thickness of 0.00085 inch, in practice such thickness may depart from such nominal value by a substantial relative amount as, say, 0.00015 inch. These tolerance variations (whatever their value) when added to tolerance variations in the thickness of coating 32 and in the amounts by which contact pads 21 are raised above lead portions 36, 37 might, if uncorrected for, cause the negative deflection of the click discs necessary to touch the contact pads to be outside the designed permissible range for the amount of negative deflection. Such an unacceptable accumulation of tolerance variations is however prevented in assembly 10 by the use of the described bars 30 on the printed wiring board 15 and by the contact pads 21 and the manner in which those pads are formed.

More specifically, irrespective of tolerance variations in the thickness of the lead portions 36, 37 of row paths 20, bars 30 will have substantially the same height above the surface of base member 16 as do those leads. Also, the height by which the tops of contact pads 21 are raised above the adjacent lead portions 36, 37 will be substantially equal to the thickness of the paths 33 on layer 32 since both such pads 21 and paths 33 are formed during the same silk screening. Thus, the difference in height between the bottom of strips 40 and the top of the contact pads 21 will depend only on the thickness of layer 32 which overlies bars 30. Hence, by virtue of the use of bars 30, and the raised contact pads 21, the thickness of paths 33 and, also, tolerance variations in the thickness of paths 20 and 33 are, all of them, cancelled out in the determination of the amount of negative deflection to touching of the click discs. Such amount is, in other words, dependent only on the thickness of coating 32. It follows that no possibly unfortunate accumulation of tolerance variations (such as has been earlier described) can occur.

Figure 5:
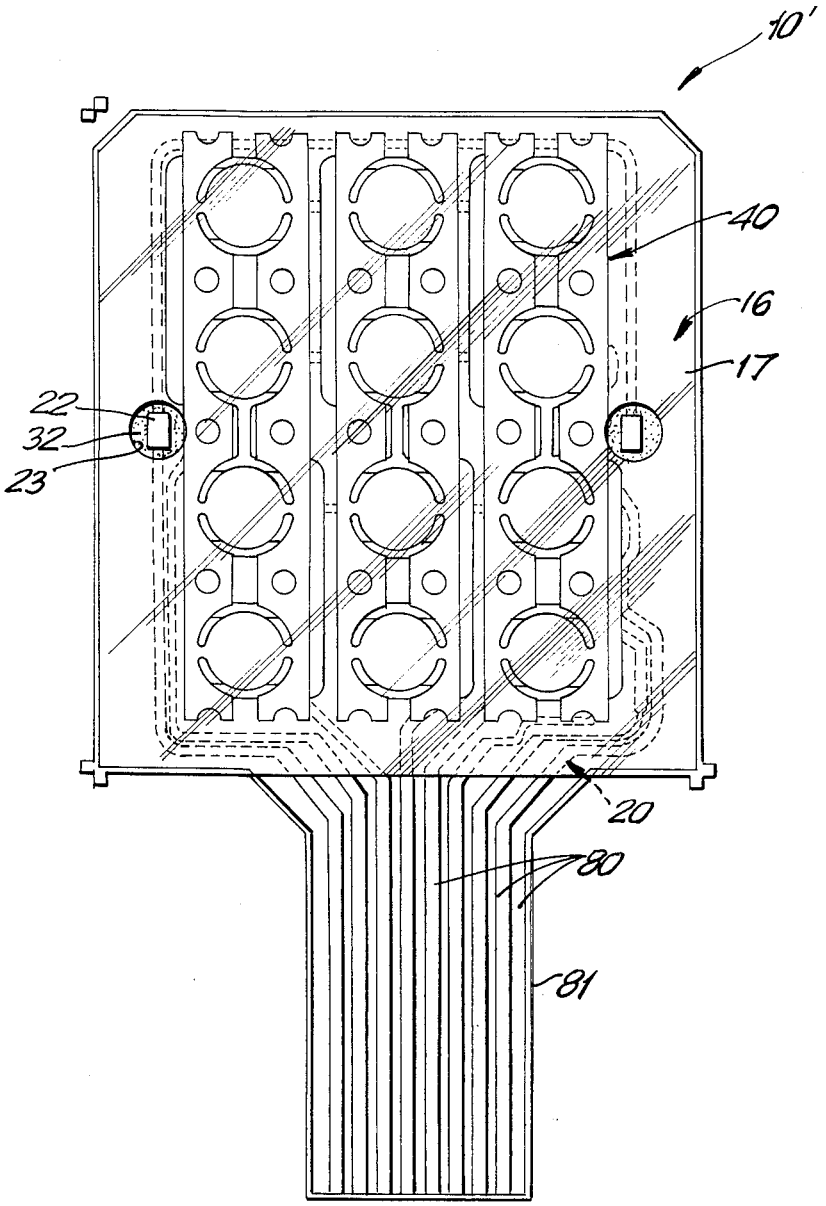
FIG. 5 is a plan view of a click disc switch assembly which is a modification of the assembly shown in FIG. 2.

FIG. 5 shows a click disc assembly 10' which is the preferred embodiment. The FIG. 5 assembly differs from that of FIG. 2 in that, in the FIG. 5 embodiment, the row and column conductors 20 on the base member 16 do not terminate at a rigidly supported edge of the base member 16. Instead, such conductors continue beyond the edge of the stiffening board 19 (FIG. 4) in the form of parallel and mutually spaced electroconductive ink paths 80 formed on the upper surface of a coupling tail 81 which is an extension of the flexible plastic sheet 17 forming the top layer of the board 16. As further differences, in the FIG. 5 embodiment, the sealing sheet 55 does not have any slot 62 formed therein, and the insulating layer 32 (overlying the base member 16 and conductors 20 on that member) does not have formed therein any apertures 24. Layer 32 may, however, if desired, be extended to cover all of the paths except for terminal portions thereof which are at the free end of tail 81, and which may each have a length of say 0.375 inch. The FIG. 5 click disc assembly may be electrically coupled through such terminal portions to a circuit board or other circuitry by appropriate connecting means as, for example, the connector disclosed in U.S. patent application, Ser. No. 325,941 for "Electrical Connector" which was filed Nov. 30, 1981 in the name of G. J. Martyniak and is assigned to the assignee hereof.

The FIG. 5 assembly may be manufactured as follows. There is provided an expanse of the flexible plastic sheet 17 having room thereon for several assemblies 10'. Electroconductive ink is deposited on such expanse to form the conductors 20 and 80 and bars 30 for each of such assemblies. Also, the expanse of sheet 17 is perforated to provide the aligning holes 14 for each of such assemblies.

Next the area corresponding to each of such assemblies is covered by an insulating layer having the described apertures 23, 28 and 29 thereon. Then there is deposited on layer 32 the electroconductive ink which forms the contact pads 21 and the paths 33 on layer 32.

With the assemblies 10' being thus far completed, the expanse of sheet 17 is placed over a fixture (not shown) comprising a flat bed and aligning pins projecting upwards from the top surface of the bed from bores in the bed in which the pins are received, and within which the pins rest on compression springs received in the bottoms of such bores. The mentioned sheet expanse is then laid down on the bed so that the pins pass through the aligning holes and registering apertures of each of such assemblies to project upward beyond the layer 32 thereof. Thereupon, the three click disc strips 40 for each assembly 10' are placed on its layer 32 so that at least a pair of such pins passes through a pair of aligning holes 43 in each such strip to align that strip correctly on its assembly 10'.

As the next step a large expanse of the sealing sheet 55 (perforated only by a pair of apertures 61, 61' for each assembly 10') is placed over the fixture and then pressed down to bond such sheet through adhesive layer 57 to all the strips 40 beneath it and to the layer 32 beneath it. In the course of such pressing down, the aligning pins will be pressed down by sheet 55 to retract against the bias of the compression springs on which they rest. Having effected such bonding of the expanse of sheet 55, the whole assemblage thus formed is lifted up off the mentioned fixture and placed on and adhered to an expanse of stiffening board 19. Die cutting is then used to separate the individual assemblies 10' with their tails 81 from waste portions of such assemblage and from each other.

The above-described embodiments being exemplary only, it is to be understood that additions thereto, omissions therefrom and modifications thereof can be made without departing from the spirit of the invention. Moreover, while such embodiment has been described in terms of its use as part of apparatus for obtaining multifrequency tone dialing in a telephone set, it will be appreciated that click disc assemblies in accordance with the invention may also be used in conjunction with, for example, X-Y matrix keyboards for electronic calculators, electronic computers and like apparatus.

Accordingly, the invention is not to be considered as limited save as consonant with the recitals of the following claims.

What is claimed is:

1. The improvement in a click disc assembly comprising: a printed wiring board including an electrically insulative base member and a plurality of first and of second electroconductive paths on such member corresponding to the rows and columns, respectively, of an X-Y matrix of contact pads disposed such that the pads in each X row thereof are parts of a respective one of said first paths, an array of metal electroconductive strips overlying such member so that the centerline of each such strip registers with the contact pads in a respective one of the Y columns of such pads, each such strip having formed therein a plurality of click discs each adapted by depression to engage a corresponding contact pad in the Y column corresponding to that strip, an insulating layer interposed between said strips and base member and having apertures for passage therethrough of said click discs, and a sealing sheet covering said strips and having on its underside an adhesive layer, said improvement comprising the features that: said strips are fixed in their positioning in the X and Y directions of said matrix only by a bonding of such strips by said adhesive layer to the underside of said sealing sheet, and said assembly further comprises a plurality of third electroconductive paths each corresponding to a respective one of said Y columns, each of said third paths (a) being disposed on said insulating layer and, at least in part, beneath the strip registering with the Y column corresponding to that path, and (b) having a junction portion which passes through an aperture in said insulating layer to join with the second path corresponding to such Y column so as to electromechanically couple such third and second paths together, and each such third path (c) being thereby adapted upon at least depression of any of the click discs in the corresponding strip to electrically couple such disc to the second path corresponding to that strip.

2. The improvement according to claim 1 in which said first and second paths are constituted of electroconductive ink.

3. The improvement according to claim 2 in which said third paths are constituted of electroconductive ink.

4. The improvement according to claim 1 in which each of said first paths includes said contact pads thereof and, also, lead portions joining said contact pads, and in which the contact pads in each such first path are parts thereof which are thicker than said lead portions thereof by an amount substantially equal to the thickness on said insulating layer of said third electroconductive paths.

5. The improvement according to claim 1 in which each of said third paths on said insulating layer comprises a main segment and pairs of branch segments of which each pair corresponds to a respective one of the click discs in the strip corresponding to that third path, and in which the branch segments in each such pair thereof are disposed beneath and on opposite sides of the corresponding click disc so as to each be transected by the centerline of the Y column corresponding to the strip including such click disc.

6. The improvement according to claim 5 in which each of said first paths includes said contact pads thereof and lead portions joining said contact pads, the contact pads in each such first path are parts thereof which are thicker than said lead portions thereof by an amount substantially equal to the thickness on said insulating layer of said third electroconductive paths, and in which said assembly further comprises pairs of bars disposed on said base member and covered by said insulating layer, each of said pairs of bars corresponding to a respective one of said pairs of branch segments of said third electroconductive paths on said insulating layer, the bars in each such pair thereof being each disposed beneath a respective one of the branch segments in the pair thereof corresponding to that pair of bars, and said bars having a thickness substantially equal to the thickness of said lead portions of said first electroconductive paths on said base member.

7. The improvement according to claim 5 in which said click disc strips and click discs thereon are of steel, each click disc in said strips has on its undersides a gold layer, and in which depression of such click disc produces, on the one hand, contact between its gold layer and the underlying branch segments corresponding to that disc and, on the other hand, contact between its gold layer and the underlying contact pad so as, thereby, to electrically couple together the first and second electroconductive paths corresponding, respectively, to the row and column locations of said pad and disc in a manner which bypasses the steel material of said disc.

* * * * *